US009676515B2

(12) United States Patent
Huggett

(10) Patent No.: US 9,676,515 B2
(45) Date of Patent: Jun. 13, 2017

(54) PANEL AND SUPPORT STRUCTURE FOR COLLAPSIBLE CONTAINER, AND COLLAPSIBLE CONTAINER

(75) Inventor: Anthony Court Huggett, Cape Town (ZA)

(73) Assignee: COMPACT CRATES LIMITED, Helier (JE)

( * ) Notice: Subject to any disclaimer, the term of this patent is extended or adjusted under 35 U.S.C. 154(b) by 2590 days.

(21) Appl. No.: 10/569,969

(22) PCT Filed: Jul. 29, 2004

(86) PCT No.: PCT/IB2004/051331
§ 371 (c)(1),
(2), (4) Date: Mar. 21, 2007

(87) PCT Pub. No.: WO2005/021391
PCT Pub. Date: Mar. 10, 2005

(65) Prior Publication Data

US 2007/0194022 A1 Aug. 23, 2007

(30) Foreign Application Priority Data

Aug. 29, 2003 (ZA) ..... 2003/6772

(51) Int. Cl.
*B65D 6/00* (2006.01)
*B65D 19/16* (2006.01)

(52) U.S. Cl.
CPC ..... *B65D 19/16* (2013.01); *B65D 13/04* (2013.01); *B65D 2519/009* (2013.01); *B65D 2519/00044* (2013.01); *B65D 2519/00064* (2013.01); *B65D 2519/0091* (2013.01); *B65D 2519/0099* (2013.01); *B65D 2519/00129* (2013.01); *B65D 2519/00184* (2013.01); *B65D 2519/00218* (2013.01); *B65D 2519/00273* (2013.01); *B65D 2519/00288* (2013.01);
(Continued)

(58) Field of Classification Search
USPC ..... 220/4.34, 4.32, 4.33, 475, 4.28; 16/221, 16/233, 234, 235, 240, 294, 337, 350, 16/225, 232; 108/51.3
See application file for complete search history.

(56) References Cited

U.S. PATENT DOCUMENTS 2,919,045 A * 12/1959 Waugh et al. ..... 220/4.34
3,405,835 A * 10/1968 Eby ..... 220/4.34
(Continued)

FOREIGN PATENT DOCUMENTS

NL 1012498 C 1/2001
WO 02/46048 A2 6/2002

OTHER PUBLICATIONS

International Search Report of PCT/IB2004/051331, mailed Nov. 24, 2004.

*Primary Examiner* — Shawn M Braden
(74) *Attorney, Agent, or Firm* — Moore & Van Allen PLLC; Henry B. Ward, III

(57) ABSTRACT

This invention relates to a collapsible container and more particularly, but not exclusively, to a collapsible container for use in packaging and transportation. The collapsible container includes a number of panels each having a panel body, with elongate tubular members secured to edges of the bodies. Each of the tubular members has at least one recessed section that forms interlocking engagement means.

24 Claims, 7 Drawing Sheets

(52) U.S. Cl.
CPC ..... *B65D 2519/00303* (2013.01); *B65D 2519/00318* (2013.01); *B65D 2519/00338* (2013.01); *B65D 2519/00358* (2013.01); *B65D 2519/00422* (2013.01); *B65D 2519/00497* (2013.01); *B65D 2519/00517* (2013.01); *B65D 2519/00601* (2013.01); *B65D 2519/00606* (2013.01); *B65D 2519/00656* (2013.01); *B65D 2519/00661* (2013.01); *B65D 2519/00711* (2013.01); *B65D 2519/00731* (2013.01)

(56) References Cited

U.S. PATENT DOCUMENTS

| | | | | |
|---|---|---|---|---|
| 5,487,345 | A * | 1/1996 | Winebarger et al. | 108/51.3 |
| 6,631,821 | B2 * | 10/2003 | Vourganas | 220/1.5 |
| 7,185,778 | B1 * | 3/2007 | Palley et al. | 220/1.5 |
| 2002/0073509 | A1 * | 6/2002 | Dean | 16/387 |

* cited by examiner

PANEL AND SUPPORT STRUCTURE FOR COLLAPSIBLE CONTAINER, AND COLLAPSIBLE CONTAINER

This application is the US national phase of International Application No. PCT/IB2004/051331, filed 29 Jul. 2004, which designated the U.S. and claims priority to South African Application No. 2003/6772, filed 29 Aug. 2003, the entire contents of each of which are hereby incorporated by reference.

FIELD OF THE INVENTION

This invention relates to a collapsible container and more particularly, but not exclusively, to a collapsible container for use in packaging and transportation.

BACKGROUND TO THE INVENTION

In order to cut shipping costs, re-usable containers are used to ship articles. Empty containers are shipped back to the owner or supplier for reuse thereof. The empty containers take up large volumes of empty space that makes shipping thereof expensive.

Collapsible, reusable containers provide a less expensive alternative to non-collapsible, reusable or non re-useable containers. Collapsible containers are not, however, always rigid and strong enough for frequent reuse.

U.S. Pat. No. 4,266,670 entitled "Collapsible Reinforced Container" discloses a four sided container attached to a rigid base for transporting heavy products. The containers may be collapsible and shipped in reduced size for reuse and reassembled into its usable form without any special tools or skills. The collapsible container of this invention provides that one or more sides may be opened for loading or unloading. Sides of the container panels have fastening means in a form of complimentary mortises and tubular tenons. The tenons are rectangular in cross section and receive solid corner posts there through. The corner posts are also square in cross section.

United Kingdom Patent application number GB 2 206 280 A entitled "Furniture Modules" discloses furniture modules of two or more panels joined through interleaving edges which edges may be tubing arranged on one edge to interleave with similar tubing on the edge of an adjacent panel. Rods extend through the hollow tubes to secure the panels together.

OBJECT OF THE INVENTION

An object of the present invention is to provide a collapsible container of the type described above.

SUMMARY OF THE INVENTION

According to the invention there is provided a panel for a collapsible container including:

a body; and an elongate tubular member secured to an edge of the body;

the tubular member having at least one cut-away section to form an interlocking formation.

There is provided for the cut-away section in the tubular member to be a section where a segment of the tubular member has been removed, and for the cut-away section to define a mortise adjacent a tenon formed by the tubular member where it is not cut-away.

There is further provided for the panel to include a securing cover for securing the tubular member to the body of the panel, the securing cover comprising a sheet of pliable material that is wrapped around the tubular member, with opposite ends of the sheet being secured to opposite sides of the body of the panel.

A further feature of the invention provides for the body of the panel to be made from reinforced material that comprises two outer laminations and an inner reinforcing structure. The inner reinforcing structure may comprise a honeycomb structure.

A still further feature provides for the outer laminations to at least partially overlie the tubular section when secured to the edge of the panel.

Further features of the invention provide for tubular members to be provided on all edges of the body; for tubular members preferably to be provided on ends of the edges of the panel and alternatively for tubular members to be provided on sides of the edges of the panel.

According to a further aspect of the invention there is provided a collapsible container comprising a number of panels each having a panel body having interlocking means on an edge of the panel body, the interlocking means being arranged to releasably interlock with complementary interlocking means on an edge of an adjacent panel, for the interlocking means to define mortises and tenons and for the motises to be shaped so that a tenon is received therein so that it cannot perfectly align axially with an adjacent tenon.

According to a further feature of the invention there is provided for the panels to be rectangular or square and to have interlocking means on all four edges.

Further according to the invention there is provided for the tenons to be hollow tubular sections and for engagement members to be receivable through adjacent tenons.

Still further according to the invention, the tenons and mortises on each edge are formed from one tubular member; and for the mortises to be formed by removing sections of the tubular member.

According to a still further feature of the invention the major axis of each tubular member is substantially parallel to the edge of the panel.

Still further according to the invention, the engagement members are solid rods or alternatively tubular cylinders.

At least one panel may have operatively downwardly protruding support structures to allow for the panel to be raised from a flat surface on which it is supported so that the tongs of a forklift are locatable underneath the panel.

There is provided for a support structure for of the collapsible container to include:

a plurality of reinforced panels;

the panels being stacked on top of one another, and being secured in a stacked position.

The support structure may further include at least one L-shaped channel section for supporting the stacked reinforced panels, and preferably includes two mirrored L-shaped channel sections for supporting the stacked reinforced panels.

The reinforced panel of the support structure may comprises two outer laminations and a reinforced inner structure, the outer laminations being made of cardboard or craft paper, and the reinforced inner structure honeycomb structured cardboard or craft paper These and other features of the invention are described in more detail below.

BRIEF DESCRIPTION OF THE DRAWINGS

An embodiment of the invention is described below, by way of example only, and with reference to the accompanying drawings in which.

DETAILED DESCRIPTION OF THE DRAWINGS

Figure 1:
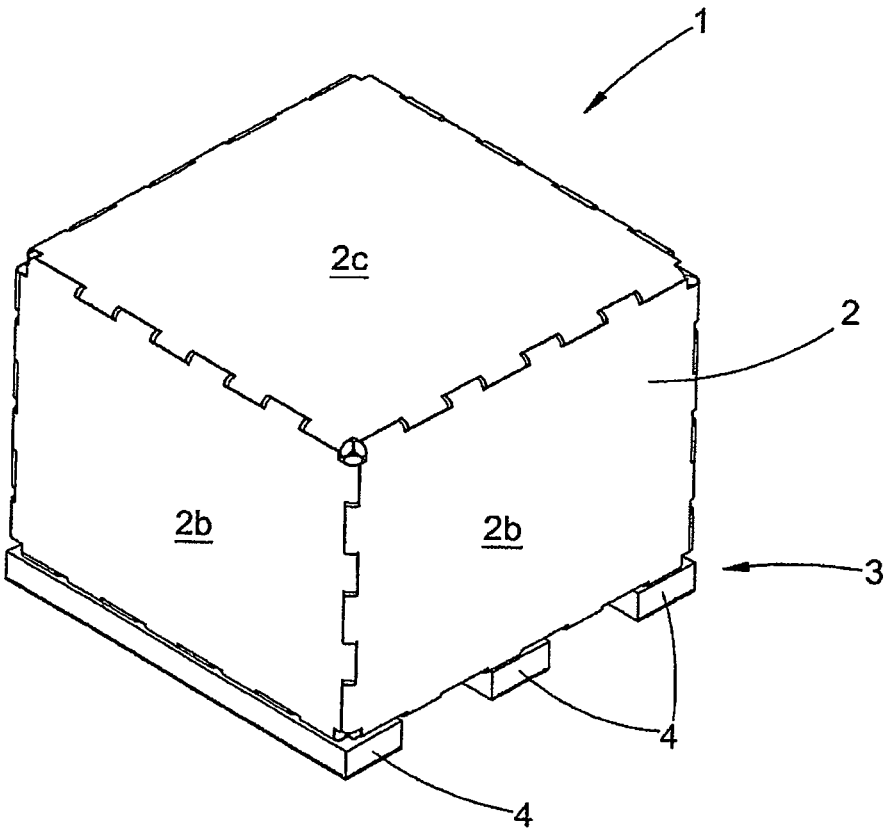
FIG. 1 shows a perspective view of a collapsible container.

With reference to the drawings, in which like numerals indicate like features, a collapsible container is generally indicated by reference numeral 1.

The container 1 is cubed shaped and consists of a number of square panels 2. More specifically, the container consists of a bottom panel 2*a*, four side panels 2*b* and a top panel 2*c*.

Each panel 2 comprises a body having elongate tubular members 26 secured to edges of the body. The tubular members include cut-away sections 7 that form interlocking formations. The interlocking formations are in the form of tubular tenons 6 and complimentary mortises 7, and are typically provided on all four edges of each panel body. It will be appreciated that an edge of each panel may include only one tenon to interlock inbetween two complimentary tenons on an adjacent panel as described below. The mortises are formed by cuffing away sections in the tubular members located on edges of the panels.

Figure 7:
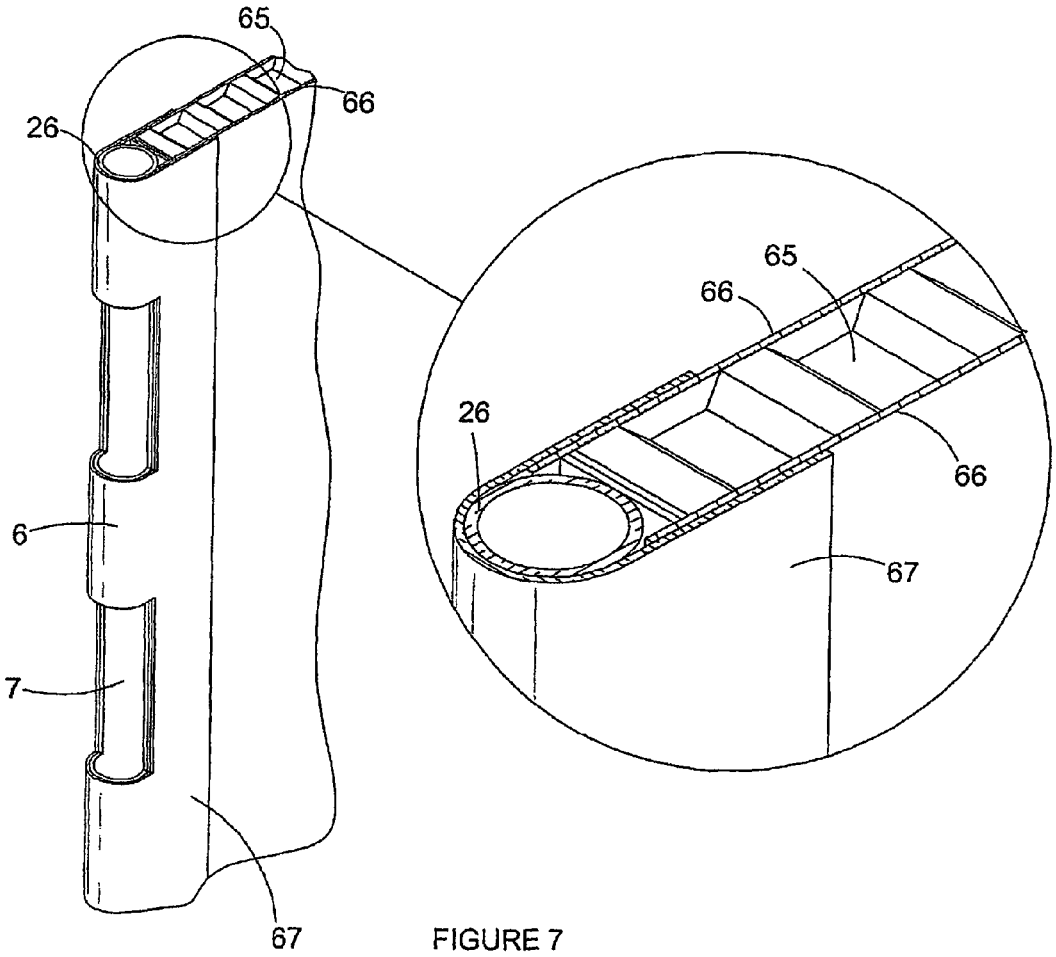
FIG. 7 shows a partial cross-sectional perspective view of an edge of a panel of the container of FIGS. 1 to 6.
Figure 8:
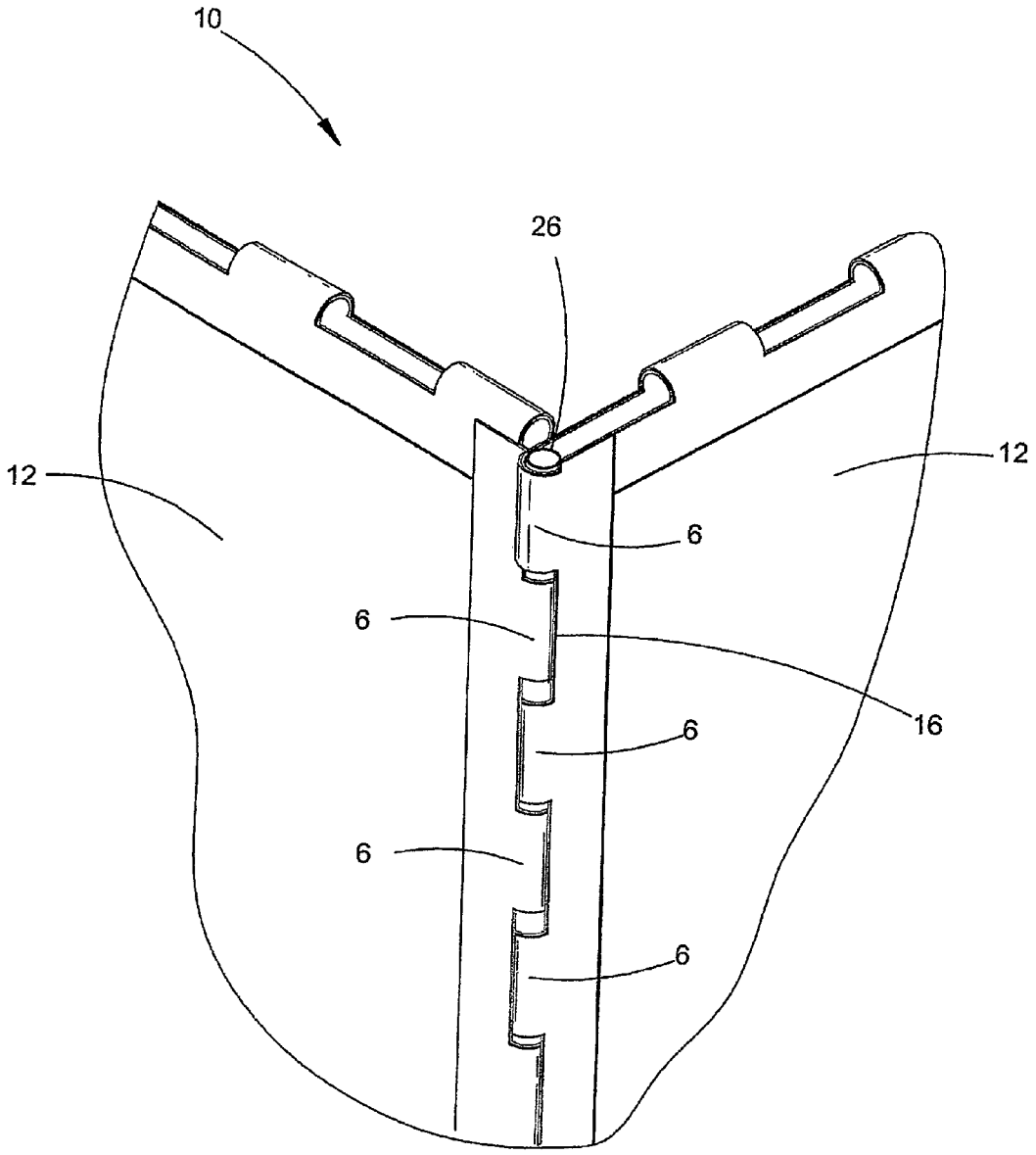
FIG. 8 shows a partial perspective view of two interlocked panels of the container of FIGS. 1 to 7.

The panel body is laminated and includes outer laminations 66 as is shown in FIG. 7 and an inner lamination 65 in the form of a honey comb type cardboard member interposed between the outer laminations 66. The panel as well as honeycomb structure may also be made from plastic, wood, steel or any other suitable material.

Each tenon 6 is made of a tube section 26 secured to the edge of the panel body 12 with an axis of each tube substantially parallel with the edge of the panel body 12. In this embodiment, the tube is secured with a paper sheet section 67 extending around the tube with opposed ends of the section 67 secured on opposite sides of the panel body. To form the cube shaped container 1, complementary mortises and tenons are engaged and engagement rods 5 are located through the tubular interengaged tenons to interlock the panels.

The mortises and tenons are formed by locating a tube 26 on an edge of each panel. The tube is then pressed into the panel and forced part-way inbetween the outer laminations and into the honeycomb member. The sheet section 67 is then glued around the tube and onto opposite sides of the panel to secure the tube in place.

Mortises are now formed by cutting the tube section at regular intervals and removing tube sections between alternate cuts so that an inner half of the tube section remains in the thus formed mortise 7. The use of one tube having only sections removed provides added strength.

Figure 2:
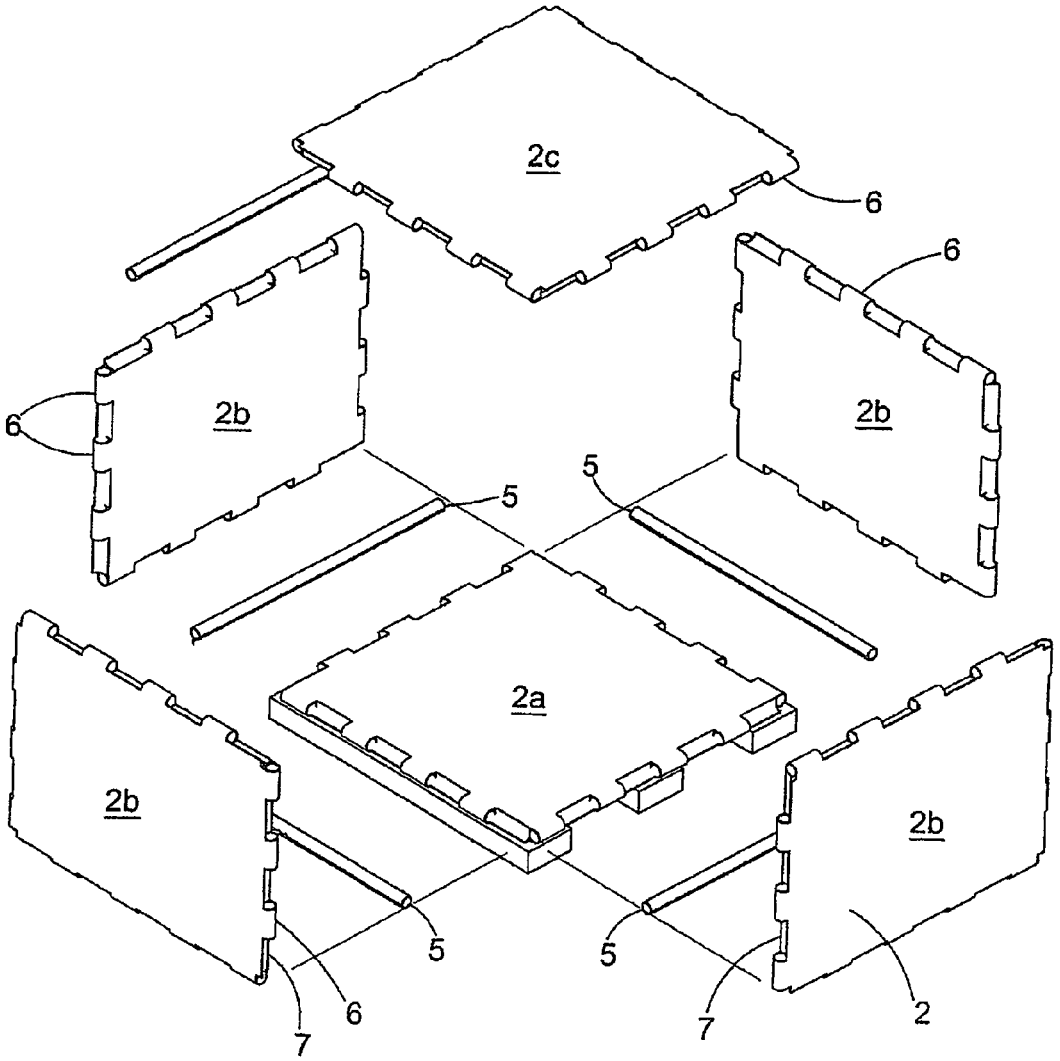
FIG. 2 shows an exploded perspective view of the collapsible container of FIG. 1.
Figure 3:
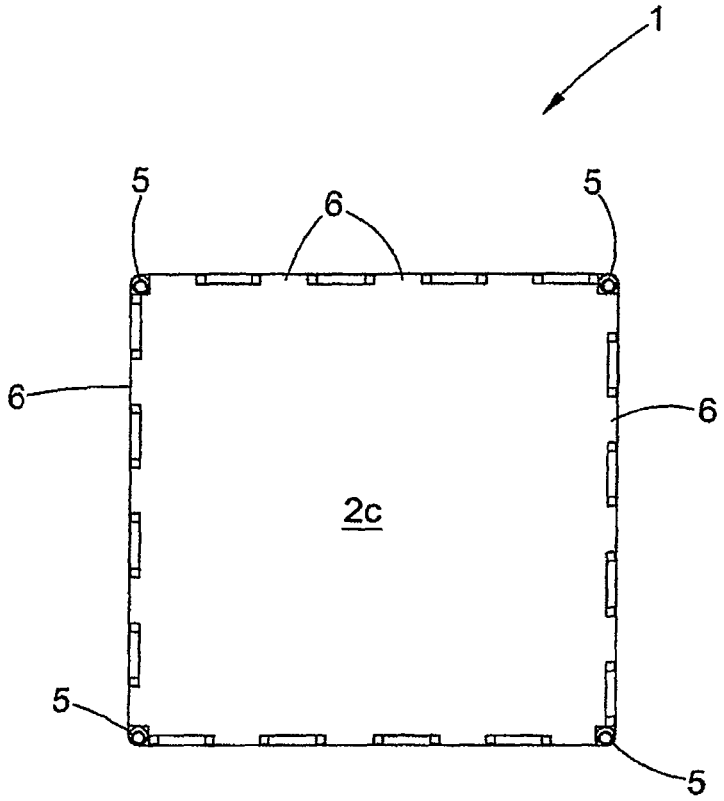
FIG. 3 shows a plan view of the collapsible container of FIGS. 1 and 2.
Figure 4:
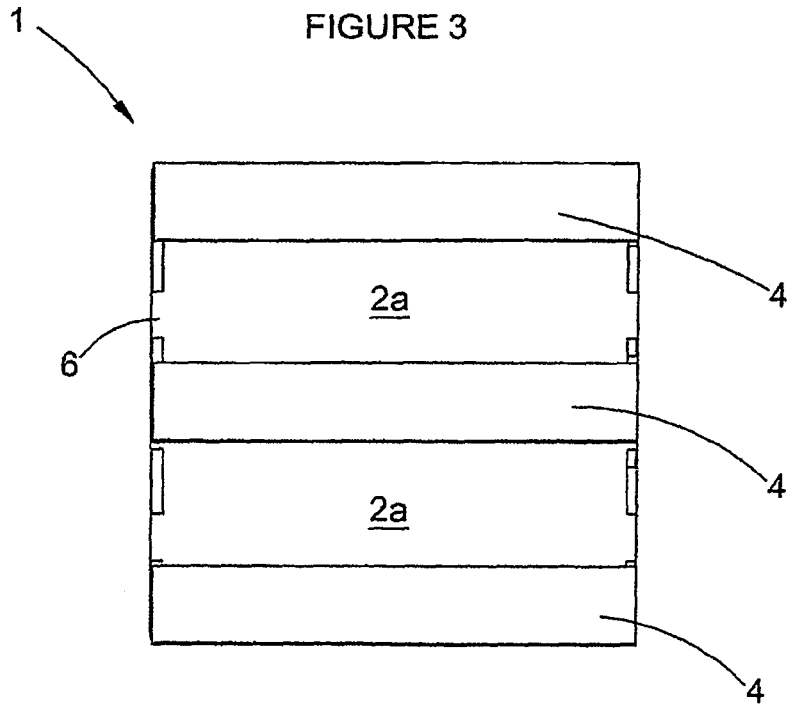
FIG. 4 shows an underside view of the collapsible container of FIGS. 1 to 3.
Figure 5:
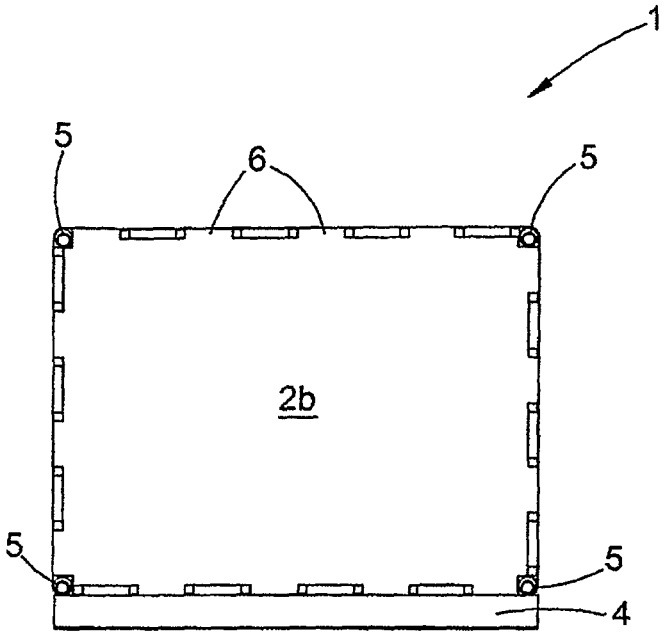
FIG. 5 shows a side elevation of the collapsible container of FIGS. 1 to 4.
Figure 6:
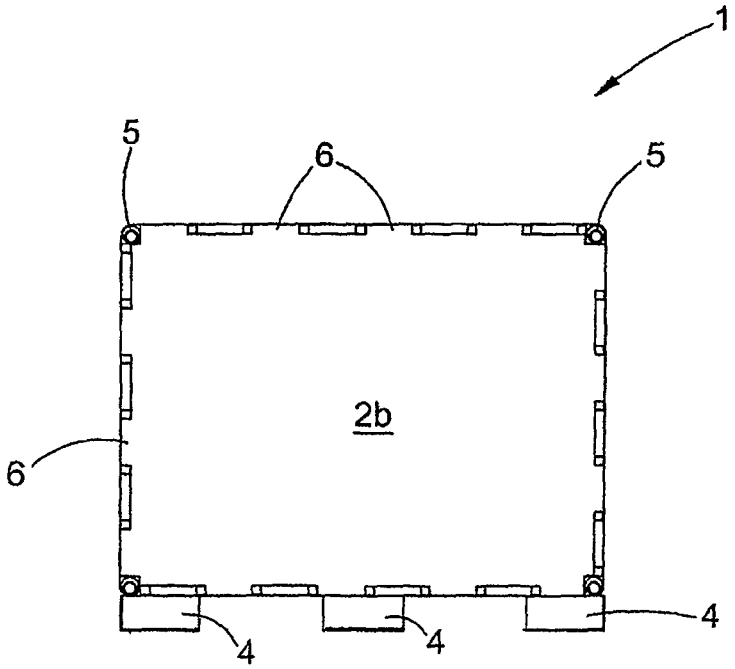
FIG. 6 shows a front innovation of the collapsible container of FIGS. 1 to 5.

The mortises are formed so that a tenon 6 of an adjacent panel received therein does not align i.e is not concentric with, adjacent tenons. This provides for a more secure or friction fit of the rods 5 through the tenons. Although FIG. 2 shows only some of the rods, it will be appreciated that twelve rods will be required to assemble a container as depicted in FIG. 2.

The bottom panel has downwardly protruding supports 4 in the form of three elongate cardboard blocks so that the bottom panel is raised from a flat surface of which it is supported by the supports. This will allow for the tongs of a forklift to be easily insertable underneath the bottom panel and thus the container.

Figure 9:
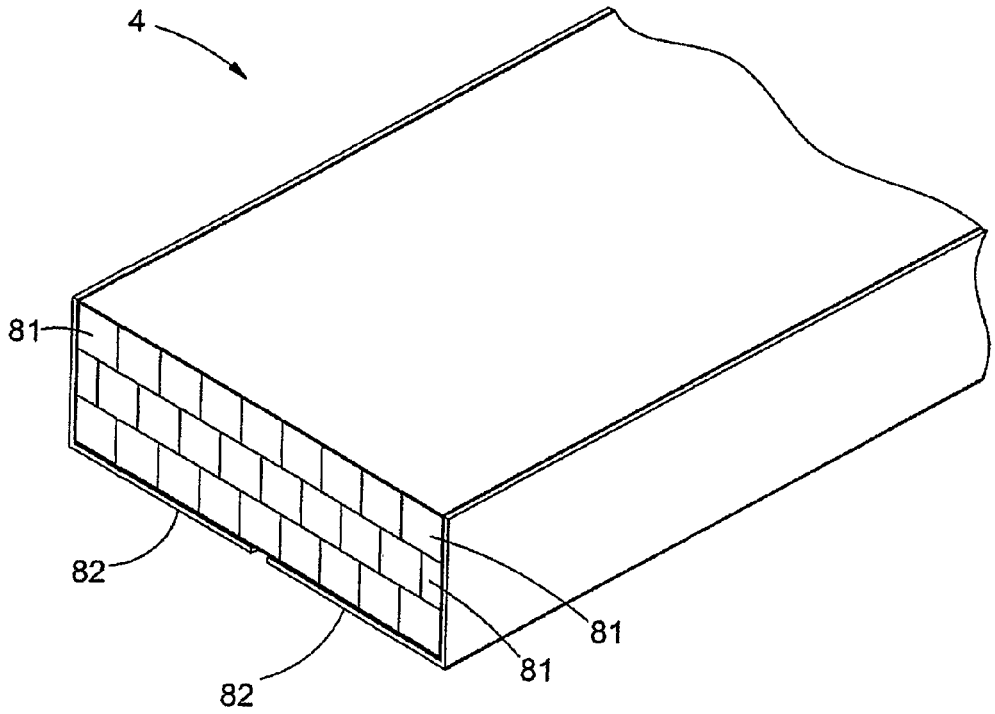
FIG. 9 shows a perspective cross-sectional view of a support structure of the container of FIG. 1 to 8.

The supports 4 are shown in more detail in FIG. 9 and include a plurality of reinforced panels 81 that are stacked and secured on top of one another. The stacked reinforced panels are supported by two elongate L-shaped channels 82 that are secured to the stacked reinforced panels by glue or any other suitable securing means. The supports are subsequently secured to the bottom of the collapsible container.

Strapping can be located through the tenons to further secure the panels together and/or to provide tamper indication.

It is envisaged that the reusable packaging will be more cost effective if the empty containers are collapsible so as not to take up unnecessary space during return shipment.

The container is made of cardboard paper and is biodegradable and may also be recycled. Some municipalities or companies may even offer payment for used containers and/or panels.

It will be appreciated that the invention is not limited to the precise details as described herein. For example, interlocking formations on adjoining panels may be released and resecured by means of a fix and fit and the engagement member need not be a rod but may be hooks or lockable pins. The panels furthermore do no have to be of rectangular shape, and may be of any polygonal shape. The panels also do not need to be entirely planar, and can be of arcuate configuration. It will furthermore be appreciated that the assembled container may be in the form of a tetrahedron, pyramid, cube or any other suitable three-dimensional configuration. It will also be appreciated that the tubular members may be located on ends of the edges of the panels, or on sides of the edges of the panels.

The invention claimed is:

1. A collapsible container comprising:

a plurality of upper panels, and a bottom panel, each panel having a body defining a plurality of edges and an elongate tubular member along each of the edges of the body;

each tubular member having at least one cut-away section to form an interlocking formation that is an alternating tenon and mortise formation, wherein each cut-away section comprises a residual portion of said tubular member, each mortise being shaped so that a tenon is received therein in an arrangement wherein the received tenon is not concentric with adjacent tenons, whereby an engagement member passing through the tenons has a secure or friction fit therein;

the bottom panel having a plurality of reinforced downwardly protruding supports comprised of a plurality of panels for raising up the bottom panel and thereby the collapsible container; and at least one interlocking formation on the bottom panel engaging an interlocking formation on at least one upper pane.

2. A collapsible container according to claim 1, wherein the tenons and mortises of adjacent panels are staggered so as to enable a tenon of a first panel to engage a mortise provided in an adjacent panel.

3. A collapsible container according to claim 1, wherein the engagement member is receivable through a passage by adjacent tenons when panels are engaged.

4. A collapsible container according to claim 3 wherein the engagement member is in the form of a solid rod.

5. A collapsible container according to claim 3 wherein the engagement member is in the form of a hollow tubular cylinder.

6. A collapsible container according to claim 1, wherein the supports include a plurality of stacked reinforced panels including at least one L-shaped channel section for supporting the stacked reinforced panels, the supports being secured to the bottom panel of the collapsible container, and wherein each reinforced panel is comprised of two outer laminations and a reinforced inner structure.

7. The collapsible container of claim 1 wherein the interlocking formations of adjacent panels are arranged to be releasably interlockable.

8. The collapsible container of claim 1 wherein the cut-away section in the tubular member of a panel is a section where a segment of the tubular member has been removed.

9. The collapsible container of claim 1 wherein the cut-away section of a panel defines a mortise adjacent a tenon formed by the tubular member where it is not cut-away.

10. The collapsible container of claim 1 wherein each panel includes a securing cover for securing the tubular member to the body of the panel, the securing cover comprising a sheet of pliable material that is wrapped around the tubular member, with opposite ends of the sheet being secured to opposite sides of the body of the panel.

11. The collapsible container of claim 1 wherein the body of a panel is made from reinforced material that comprises two outer laminations and an inner reinforcing structure.

12. The collapsible container of claim 11 wherein the outer, laminations at least partially overlies the tubular section when secured to the edge of the panel.

13. The collapsible container of claim 11 wherein the inner reinforcing structure comprises a honeycomb structure.

14. The collapsible container of claim 1 wherein the tubular members are provided on ends of the edges of a panel.

15. The collapsible container of claim 1 wherein the tubular members are provided on sides of the edges of a panel.

16. The collapsible container of claim 1 wherein the body of a panel is substantially rectangular.

17. The collapsible container of claim 1 wherein the body and tubular members of a panel are made from cardboard.

18. The collapsible container of claim 1 wherein each support includes a plurality of reinforced panels stacked on top of one another, the stacked reinforced panels being secured in a stacked position.

19. The collapsible container of claim 18 wherein each support includes at least one L-shaped channel section for supporting the stacked reinforced panels.

20. The collapsible container of claim 19 wherein each support includes two mirrored L-shaped channel sections for supporting the stacked reinforced panels.

21. The collapsible container of claim 18 wherein each reinforced panels is comprised of two outer laminations and a reinforced inner structure.

22. The collapsible container according to claim 21 wherein the outer laminations are made from cardboard or craft paper.

23. The collapsible container according to claim 21 wherein the reinforced inner structure comprises honeycomb structured cardboard or craft paper.

24. The collapsible container according to claim 21 wherein the reinforced inner structure comprises tubular cardboard sections.

* * * * *